US008850731B2

(12) United States Patent
Botty et al.

(10) Patent No.: US 8,850,731 B2
(45) Date of Patent: Oct. 7, 2014

(54) GUN WITH AUTOMATIC LOADING OF CARTRIDGES

(71) Applicant: Browning International, Societe Anonyme, Herstal (BE)

(72) Inventors: Alain Botty, Ayeneux (BE); Marc Boland, Meadela (PT)

(73) Assignee: Browning International, Societe Anonyme, Herstal (BE)

( * ) Notice: Subject to any disclaimer, the term of this patent is extended or adjusted under 35 U.S.C. 154(b) by 118 days.

(21) Appl. No.: 13/724,558

(22) Filed: Dec. 21, 2012

(65) Prior Publication Data

US 2014/0075809 A1 Mar. 20, 2014

(30) Foreign Application Priority Data

Dec. 23, 2011 (BE) ..... 2011/0761

(51) Int. Cl.
*F41A 9/61* (2006.01)
*F41A 9/72* (2006.01)

(52) U.S. Cl.
CPC ..... *F41A 9/72* (2013.01)
USPC ..... 42/49.01; 42/11; 42/50

(58) Field of Classification Search
CPC ..... F41A 9/72; F41A 9/65; F41A 9/73; F41A 9/70; F41A 9/64; F41A 9/18; F41A 9/62; F41A 9/68; F41A 9/75; F41A 9/67; F41A 9/69; F41A 11/02; F41A 17/38; F41A 9/83; F41A 17/56; F41A 9/26; F41A 9/35; F41A 9/47; F41A 9/66
USPC ..... 42/11, 49.01, 50
See application file for complete search history.

(56) References Cited

U.S. PATENT DOCUMENTS

| | | | | | |
|---|---|---|---|---|---|
| 1,487,800 | A | * | 3/1924 | Pedersen | 42/17 |
| 1,855,402 | A | * | 4/1932 | Loomis | 42/49.01 |
| 1,855,404 | A | * | 4/1932 | Loomis | 42/49.02 |
| 2,026,252 | A | | 12/1935 | Russell et al. | |
| 2,129,729 | A | * | 9/1938 | Blizard | 42/49.02 |
| 3,142,921 | A | * | 8/1964 | Ruger | 42/17 |
| 3,165,852 | A | | 1/1965 | Into | |
| 3,650,060 | A | | 3/1972 | Schubert | |
| 3,883,976 | A | * | 5/1975 | Norman et al. | 42/49.01 |
| 4,087,930 | A | * | 5/1978 | Grehl | 42/75.02 |
| 4,736,540 | A | | 4/1988 | Holmes | |

* cited by examiner

*Primary Examiner* — Samir Abdosh
(74) *Attorney, Agent, or Firm* — Sughrue Mion, PLLC

(57) ABSTRACT

Improved gun with automatic loading of cartridges, comprising a cartridge loader in the form of a tubular magazine (4), characterized in that:

The magazine bottom (18) is mounted in a way so that it can slide in the axial direction (X-X') with respect to the tubular magazine (4).

The sliding magazine bottom (18) is equipped with a shock absorber (26) able to absorb the shocks exerted on the magazine bottom (18) in the axial direction (X-X') of the tubular magazine (4).

The cartridge follower assembly (19) provided with a shock absorber (29) that can absorb the shocks exerted on the follower assembly (19) in the axial direction (19) of the tubular magazine (4).

7 Claims, 9 Drawing Sheets

GUN WITH AUTOMATIC LOADING OF CARTRIDGES

The invention concerns an improved gun with automatic loading of cartridges.

The cartridges are cartridges of the tubular type loaded with metal pellets, and are housed in a tubular magazine that acts as a loader mounted on the gun.

The invention is intended for guns with automatic loading in general, also including loading systems that operate by using gas, and loading systems that operate by using the energy developed by the recoil.

For this type of gun it is known that when firing, the energy supplied by part of the gases or the recoil of the weapon is utilised to enable moving parts in the receiver assembly to extract and eject the used case, and also to feed a new cartridge from the tubular magazine into the chamber of the barrel. The weapon is then ready to be fired a next time.

The tubular magazine is interlocked with the receiver assembly and extends in the radial direction essentially parallel to the axis of the barrel.

Assembly of the barrel assembly with the receiver assembly is done in a known manner by using an assembly nut that is screwed on the front end of the tubular magazine.

The tubular magazine comprises a magazine bottom at the front end and an exit on the other end on the receiver side, on which side is provided a cartridge stop that is mounted in the receiver and which, after firing, is moved back by the movements of the moving parts or by the state of the trigger guard assembly (system for releasing the conveyors and stops controlled by the pulling of the hammer during firing) in order to free the exit of the tubular magazine so that a next cartridge can leave the tubular magazine.

The cartridges in the magazine are pushed back towards the exit at the receiver by means of a follower assembly that is fitted in a way so that it can slide in the axial direction in the tubular magazine, and by means of a spring fitted in the tubular magazine between the magazine bottom and the follower assembly, and which is compressed in the axial direction so as to be able to exert a force on the follower assembly in the direction of the receiver.

In certain cases the tubular magazine can be equipped with a magazine reducer that limits the cartridge capacity of the magazine. In fact the authorised cartridge capacity depends on the applicable legislation, the type of discipline and the length of the cartridges.

In order to be able to use the gun with or without reducer, depending on the case, the magazine reducer may be fixed or detachable.

The problem presented by conventional guns of this type is that in certain cases its firing can lead to a permanent undesired deformation of the cartridges in the tubular magazine.

Elaborate tests have demonstrated that the phenomenon that lies at the basis of these undesired deformations lies in the fact that, during the recoil phase of the weapon after having fired a cartridge, the cartridges still in the tubular magazine undergo significant movements in the tubular magazine, leading to the severe impact of the cartridge follower assembly with either the magazine reducer or the magazine bottom.

The deformation of the cartridges due to the recoil shock can be such that it becomes impossible to insert the cartridges into the chamber of the barrel assembly.

In this case the feed is no longer automatic and leads to an operating problem for the weapon.

In case of U.S. Pat. No. 3,650,060 the risk of crushing the cartridges is even more important with respect to a classical gun because said patent discloses an additional inertia mass in the magazine tube with the objective to reduce the effect of the recoil shock of the gun on the shoulder of the shooter after a shot has been fired and of which the cartridge follower comprises a shock absorber to reduce the shock due to the return of the inertia mass.

The objective of the invention is to avoid the above-mentioned problems.

This objective is achieved according to the invention by a classical gun of the said type in which:

- the tubular magazine is equipped with a magazine bottom shock absorber that is joined with the assembly nut, which nut, in addition to its assembly function, is in contact with the magazine bottom through the intermediary of the magazine bottom shock absorber;
- the magazine bottom can slide over a travel distance D while being remaining joined with the tubular magazine, said travel distance allowing the magazine bottom shock absorber to damp the impact of the cartridge follower assembly with, either the magazine reducer or the magazine bottom or both;
- the cartridge follower assembly being provided with a shock absorber between the cartridge follower and the magazine spring.

When the cartridge is fired in the chamber of the barrel, this cartridge opens out and releases its load. The energy developed by the cartridge propels the load towards the muzzle of the barrel, but it also causes the recoil phenomenon of the weapon. Because of their own mass, the cartridges in the tubular magazine tend to stay in place due to the phenomenon of inertia, while the whole of the weapon moves back.

This phenomenon results in a relative movement of the cartridges in the tubular magazine towards the magazine bottom at the front end of the tubular magazine, against the force exerted by the magazine spring on the cartridge follower assembly, strongly compressing this spring and leading to an impact, with a severe contact shock, of the cartridge follower assembly, with either the magazine reducer or the magazine bottom.

Thanks to the invention, the contact shocks between the cartridge follower assembly and the magazine reducer and/or the magazine bottom can be cushioned or even absorbed by shock absorbers provided at the level of the magazine bottom and/or at the level of the cartridge follower, in this way avoiding severe shocks through the impact of the cartridges in the tubular magazine against the cartridge follower assembly, thus reducing the risk of undesired deformation of the cartridges, and thus the risk of the poor operation of the gun.

The implementation of the present invention has also as a consequence to improve the reliability of the automatic recharging system of the gun.

Indeed, the implementation of the shock absorbers has the secondary consequence to temporize the exit of the cartridges from the tubular magazine with an additional delay, allowing the automatic recharging system (mobile breech assembly-trigger guard assembly) to stabilize its position, called "breech stop" prior to receive the next cartridge from the tubular magazine.

Said stabilisation allows to finalise the charging cycle, comprising rising of the transporter, closing the breech, charging the next cartridge in the chamber et locking of the chamber, with greater reliability.

For greater clarity, a few example embodiments of an improved gun with automatic loading of cartridges according to the invention are described hereinafter by way of an example, without any limiting nature, with reference to the accompanying drawings, wherein.

Figure 3:
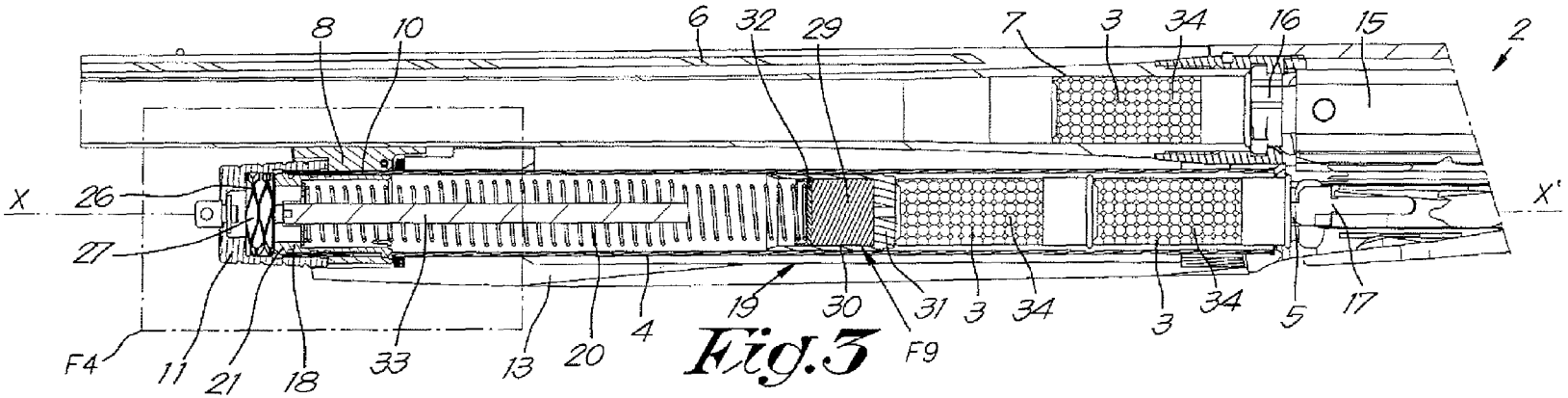
FIG. 3 shows a cross-section according to the plan of FIG. 1 of the part indicated by F3 in this FIG. 1.
Figure 4:
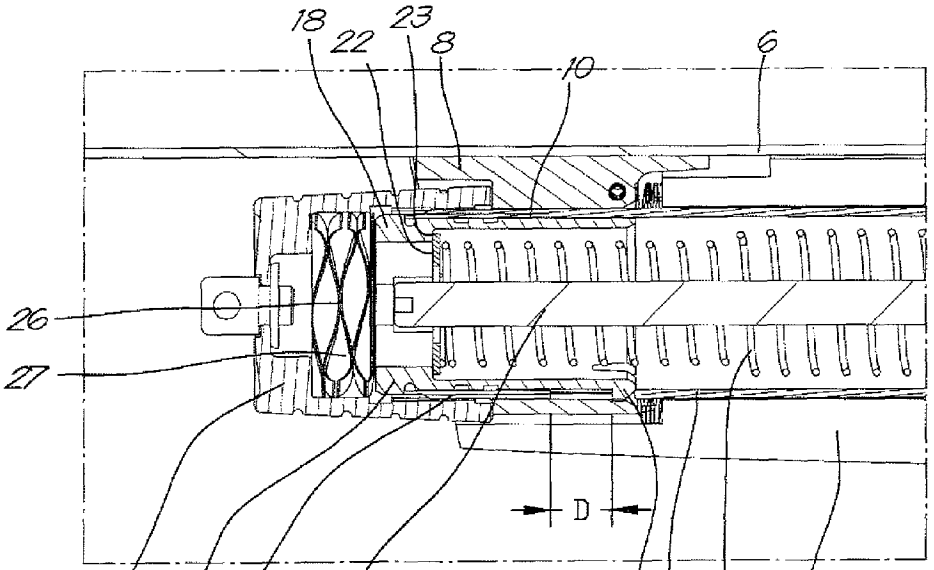
FIG. 4 is a view on a larger scale of the part indicated by F4 in FIG. 3.
Figure 5:
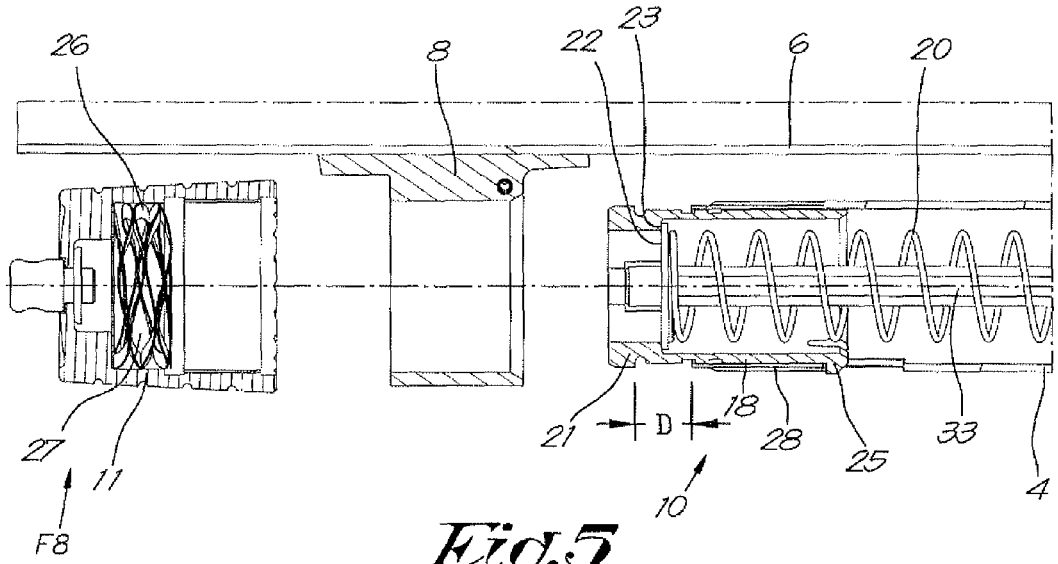
FIG. 5 is a view such as that of FIG. 4, but in a dismantled state, as in the case of FIG. 2.
Figure 6:
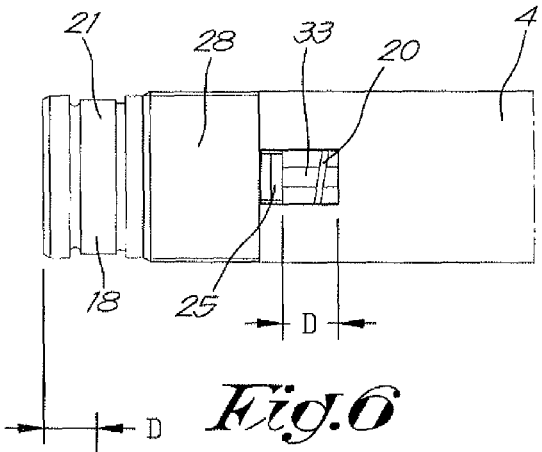
FIG. 6 is a view in the direction of the arrow F6 in FIG. 5.
Figure 7:
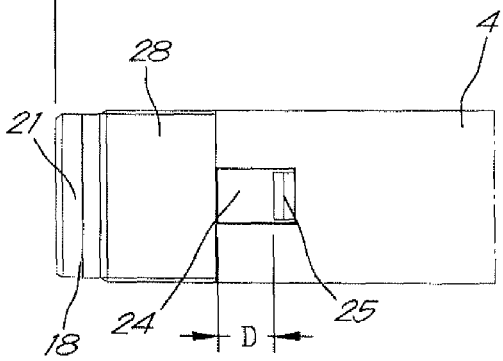
Figure 8:
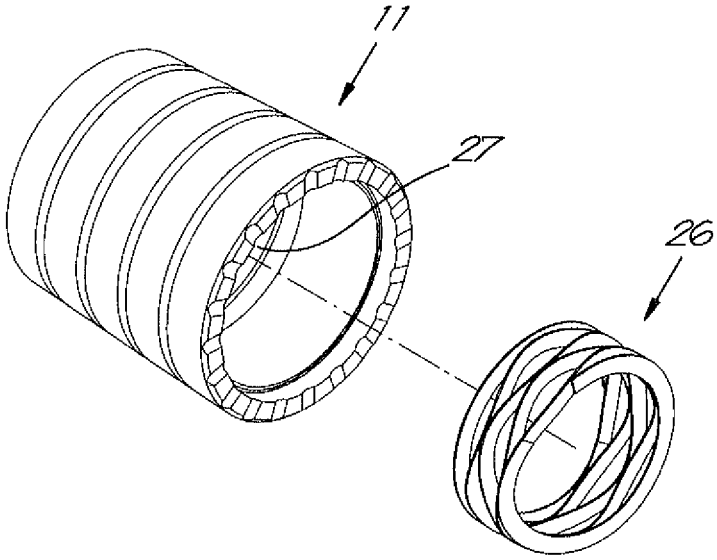
Figure 9:
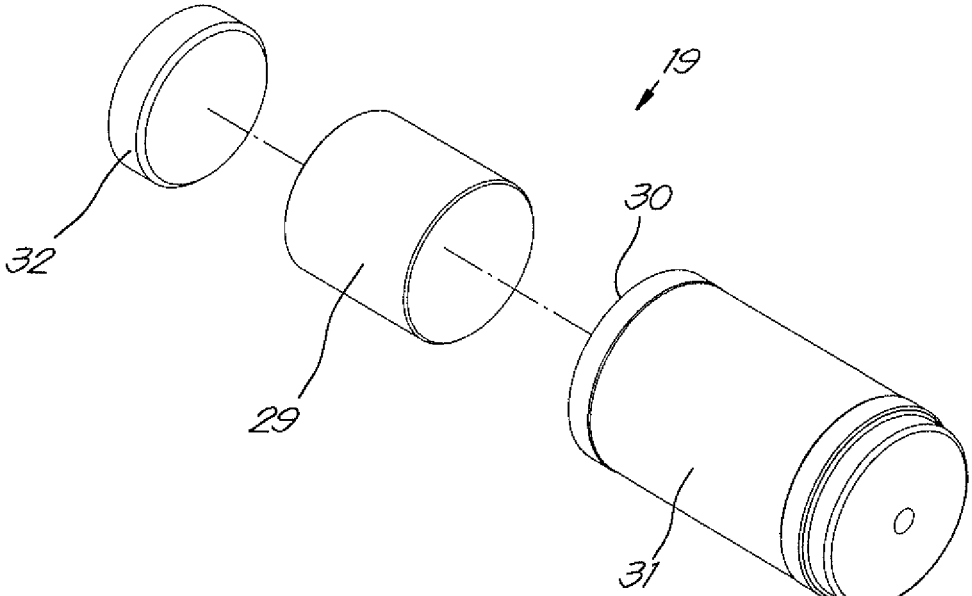

FIG. 7 corresponds to FIG. 6, but in another position;

FIG. 8 is a perspective view of the part indicated by F8 in FIG. 5;

FIG. 9 is a perspective view of the assembly indicated by F9 in FIG. 3;

FIGS. 10 to 13 show similar views to that of FIG. 3, but each one for the successive states during firing;

FIGS. 14 to 18 correspond respectively to FIGS. 3 and 10 to 13, but for a variant of a gun according to the invention.

In a generally known way, a gun with automatic loading of cartridges comprises:

A receiver assembly 2;

A cartridge 3 loader in the form of a tubular magazine 4 that is interlocked with the receiver assembly 2 and which comes out at the level of this receiver assembly 2 via an exit 5.

A barrel assembly 6, which extends in the axial direction essentially parallel to the axis of the tubular magazine 4 and which has a chamber 7 to receive a cartridge 3 to be fired, and a barrel ring 8 enabling it to be positioned with respect to the tubular magazine 4, and comprising a barrel extension 9 containing a part of the locking system for the cartridge 3 in the chamber 7.

Figure 1:
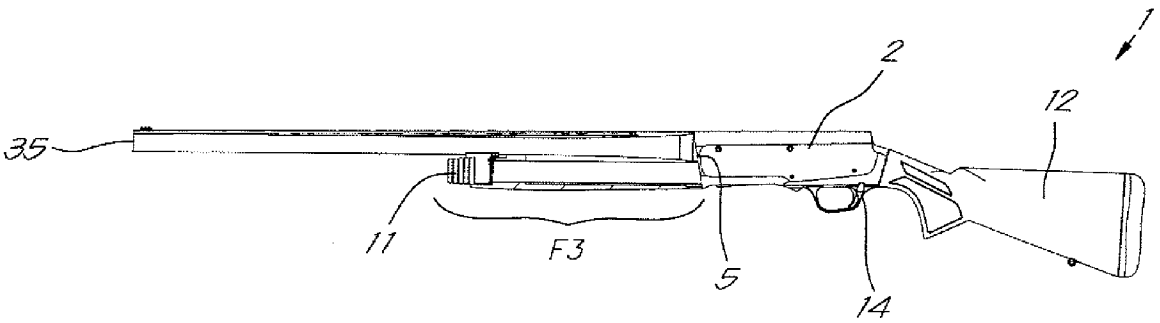
FIG. 1 is a schematic side view of a self-loading gun according to the invention.
Figure 2:
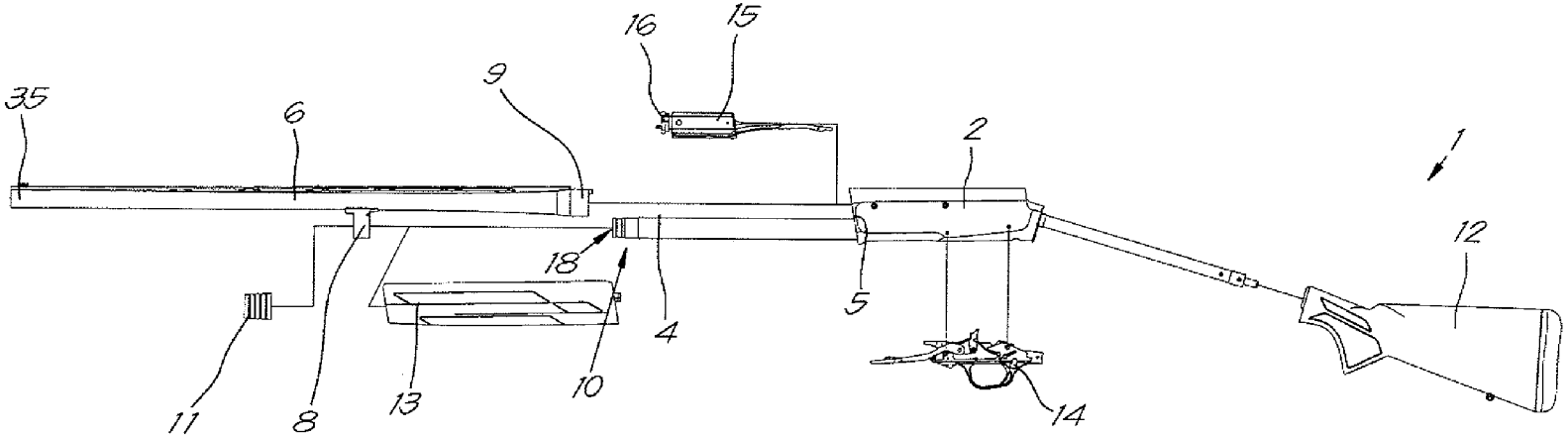
FIG. 2 shows an exploded view of the gun of FIG. 1.

A system for supporting the barrel 6, which connects the barrel assembly 6 and the receiver assembly 2 and the tubular magazine 4, for example as illustrated in FIGS. 1 and 2, by the ring 8 of the above-mentioned barrel, which is slid on the front end 10 of the tubular magazine 4 and which is assembled by an assembly nut 11 screwed onto the front end 10 of the tubular magazine 4.

A stock assembly 12 that is interlocked with the receiver assembly 2 by any fastening system.

A forend assembly 13 that is slid onto the tubular magazine 4 and which is interlocked with the barrel assembly 6 and the receiver assembly 2 by the barrel support system.

A trigger guard assembly 14 that is also fastened to the receiver assembly 2, and which contains in a known way the starting functions (trigger, catch, separator, hammer, etc) and the chamber feed functions (conveyors).

A breechblock assembly 15 that is mounted in the receiver assembly 2 and which can slide in it, with this breechblock assembly 15 being interlocked with a bolt assembly 16 that can engage with the part of the locking system of the barrel extension 9 in order to lock a cartridge 3 in the chamber 7, and to a cocking lever and a breech rod that is in contact with a follower in the receiver assembly 2 and which itself is in contact with a recuperator spring that tends to keep the breechblock assembly 15 locked to the end of the barrel assembly 6 on the chamber 7 side.

A cartridge stop 17 at the exit 5 of the tubular magazine 4 in the receiver assembly 2, with this stop 17 being controlled by the movement of the moving parts or by the state of the trigger guard assembly (system for releasing the conveyors and the stops controlled by the pulling of the hammer) during firing in order to block this exit 5 to keep the cartridges 3 in the tubular magazine 4 and to free the exit 5 of the tubular magazine 4 in order to rearm the gun 1 with a new cartridge 3 after firing.

The embodiment details of the moving parts in the receiver assembly 2, the trigger guard assembly 14 and the breechblock assembly 15 are well known to a man skilled in the art and are outside the scope of this description of the invention.

The tubular magazine 4 acts as a loader and it contains additional cartridges 3 to those present in the chamber 7 of the barrel assembly 6.

At the front end 10 of the side opposite the receiver assembly 2, the tubular magazine 4 contains a magazine bottom 18. This magazine bottom 18 is interlocked with the tubular magazine 4.

The tubular magazine 4 is provided with a follower assembly 19 that slides in the axial direction X-X' in the tubular magazine 4, and with a magazine spring 20 that is compressed between the magazine bottom 18 and the follower assembly 19 to exert a permanent force on the follower assembly 19 and on the cartridges 3 in the tubular magazine 4 in the direction of the exit 5 of the tubular magazine 4 at the receiver assembly 2.

The magazine spring 20 thus tends to permanently push the cartridge follower assembly 19 towards the receiver assembly 2. The cartridge follower assembly 19 is kept in the tubular magazine 4 by an end stop, not shown, in the receiver assembly 2.

The magazine spring 20 and the cartridge follower assembly 19 are slid inside the tubular magazine 4.

According to an aspect of the invention, the magazine bottom 18 is mounted in a way that it can slide in the axial direction X-X' with respect to the tubular magazine 4, while remaining joined to the tubular magazine.

According to a preferred embodiment, the magazine bottom 18 is formed by a socket 21 that is mounted telescopically in the front end 10 of the tubular magazine 4, and which comprises a support 22 for the magazine spring 20, with this support 22 being realised in the example of the drawings by a washer that rests on a shoulder 23 inside the magazine bottom 18.

The travel of the socket with respect to the tubular magazine can be limited by means to limit this travel D, for example by providing a notch 24 in the tubular magazine 4, which extends in the axial direction X-X' of the tube 4 as of a distance from the front end 10 of the tubular magazine 4 and by providing a tooth 25 located on the outside surface of the socket 21 of the magazine bottom 18 and which is guided in the axial direction X-X' in the notch 24.

The assembly nut 11 is equipped with a shock absorber 26 able to absorb the shocks exerted on the magazine bottom 18 in the axial direction X-X' of the tubular magazine 4, with this shock absorber 26 being realised for example by a spring mounted in the assembly nut 11, which to this end comprises a hollow 27.

The assembly nut 11 is screwed onto the front end 10 of the tubular magazine 4, which to this end is equipped with an external thread 28.

By screwing the assembly nut 11 and the shock absorber 26 onto the front end 10 of the tubular magazine 4, the magazine bottom 18 is pushed back towards the interior of the tubular magazine 4 against the force of the magazine spring 20 exerted on the magazine bottom 18.

During assembly of the gun, the assembly nut 11 is tightened so that the magazine bottom 18 moves towards the interior over its maximum travel D, without this spring that acts as a shock absorber 26 being completely compressed, balancing this way the spring forces.

So that the shock absorber 26 of the magazine bottom 18 is not compressed while screwing the assembly nut 11, the shock absorber 26 spring is chosen so as to be a spring which, at rest, is more resistant to compression than the magazine spring 20 in its compressed state.

According to another aspect of the invention, the cartridge follower assembly 19 comprises a shock absorber 29 that pushes onto the magazine spring 20 and which, for example, is manufactured from a shock-absorbing viscoelastic technical material.

In the example of the drawings, this shock absorber 29 is mounted in a hollow 30 of the cartridge follower 31 and pushes on the magazine spring 20 through the intermediary of a support 32, for instance in the form of a washer, able to slide in the axial direction X-X' in the hollow of the follower 31 for preventing damages on the material of the shock absorber 29.

In the case of the gun of FIGS. 1 to 13, the gun is equipped with a magazine reducer 33, which limits the cartridge capacity according to the applicable legislation, the type of discipline and the length of the cartridges.

In the example shown, the reducer 33 is presented in the form of a rod interlocked with the magazine bottom 18, and which extends axially in the tubular magazine 4 from the magazine bottom 18 in the direction of the cartridge follower assembly 19.

The reducer rod 33 has a head enabling it to be kept in a housing provided to this end in the magazine bottom 18. It is interlocked with the magazine bottom 18, for example by the washer 22 of the magazine bottom 18, itself kept in place by the pressure exerted by the magazine spring 20.

The operation of the absorption of shocks on the cartridges in the tubular magazine 4 is simple and as follows.

In the situation of FIG. 3, the gun 1 has an unfired cartridge 3 in the chamber 7 of the barrel assembly. This cartridge 3 contains a load of metal pellets 34.

The breechblock 15 is locked onto the barrel assembly 5.

Two cartridges 3 with a load 34 have been put in the tubular magazine 4. These cartridges 3 are kept in the tubular magazine by the cartridge stop system 17. In the normal position, this cartridge stop system 17 permanently keeps the cartridges in the tubular magazine 4. In this position the gun 1 is thus loaded and ready to fire.

Figure 10:
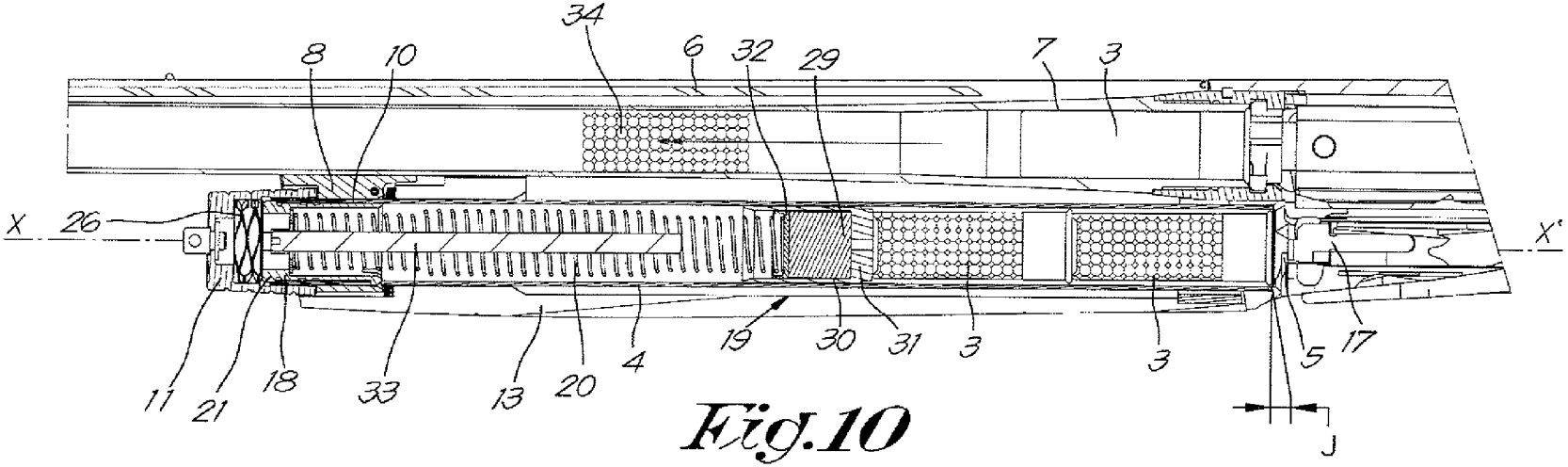

FIG. 10 shows the gun 1 just after firing. During firing, the cartridge in the chamber opens out and releases its load 34. It becomes an empty cartridge. The breechblock assembly 15 is still interlocked with the barrel assembly 5. The energy developed by the fired cartridge propels the load 34 towards the muzzle of the barrel 35, but also causes the recoil of the weapon. Because of their own mass, the cartridges 3 in the tubular magazine 4 tend to stay in place due to the phenomenon of inertia, while the entire weapon moves back. This is shown by the dimension "J", which represents the play between the cartridge stop 17 and the loaded cartridges 3 in the tubular magazine 4. The magazine spring 20 compresses strongly.

Figure 11:
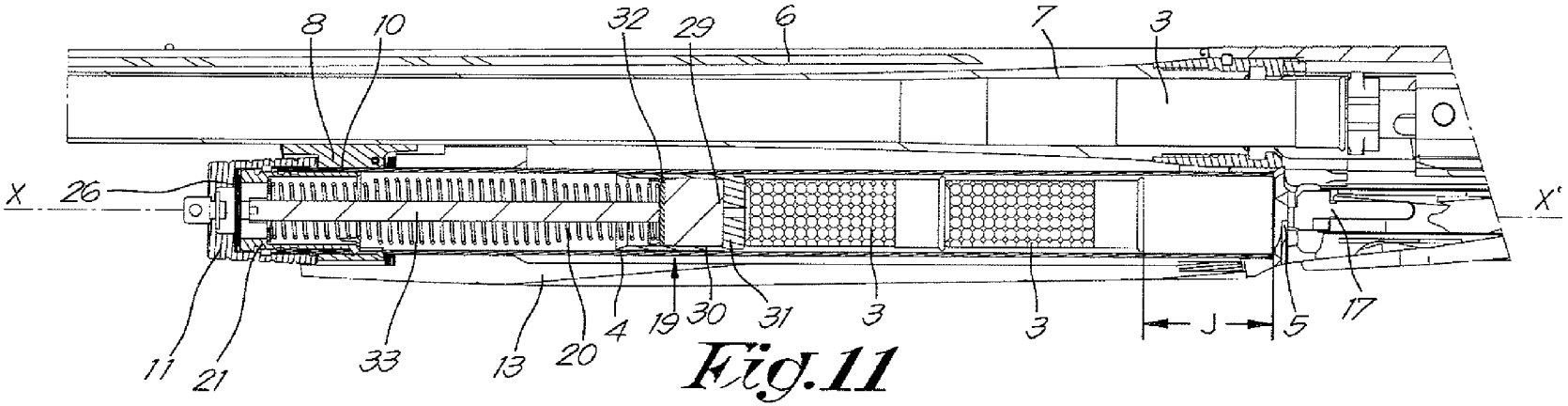

FIG. 11 corresponds to a position called "maximum recoil" and represents the time at which the loaded cartridges 3 in the tubular magazine 4 have reached the "maximum play" with the cartridge stop 17. This movement is limited by the contact between the cartridge follower assembly 19 and the magazine reducer rod 33.

The shock felt by the cartridges due to the contact of the magazine reducer 33 with the cartridge follower assembly 19 is dampened, on the one hand by the shock absorber 29 in the cartridge follower 19 and on the other hand by the shock absorber of the magazine bottom 18 which dampens the shock transmitted via the magazine reducer on the magazine bottom 18.

The breechblock assembly 15 unlocks from the barrel assembly 6 and starts to open. The empty cartridge 3 in the chamber is then being extracted.

Figure 12:
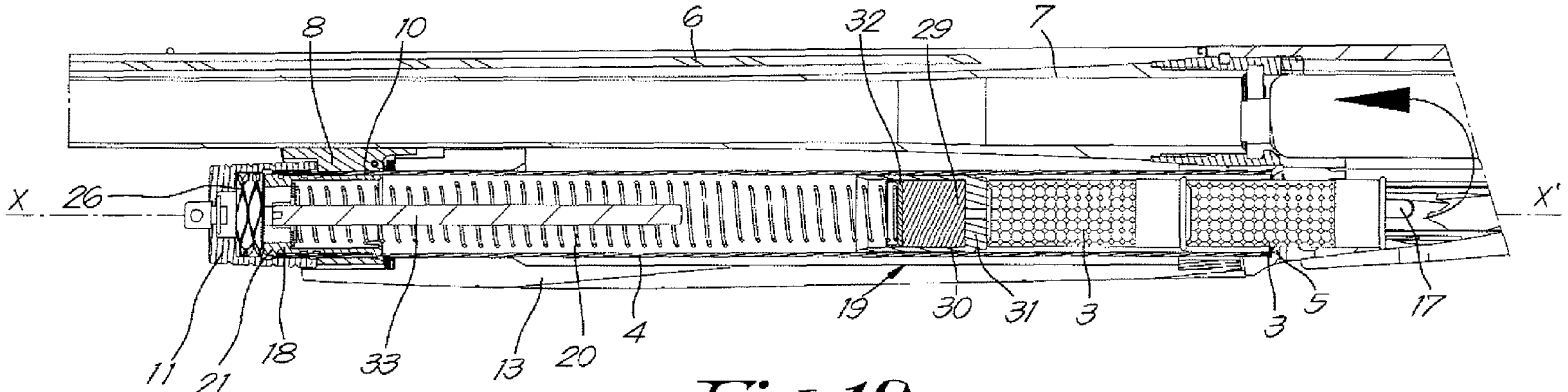

FIG. 12 shows the exit of a new loaded cartridge 3 from out of the tubular magazine 4 in order to feed the chamber 7 for the next shot.

The cartridge follower assembly 19 is pushed back towards the receiver assembly 2 under the effect of the pressure exerted by the magazine spring 20. The cartridge follower assembly 19 also pushes back all the loaded cartridges 3 in the tubular magazine 4 in this direction.

The cartridge stop system 17 is released by a control system linked to the movement of the breechblock assembly 15 or the state of the trigger guard assembly 14. In this position, it does not prevent the next cartridge 3 from leaving the tubular magazine 4. The control of the cartridge stop system 17 only allows the exit of a single cartridge 3 and blocks the next cartridge 3 in the tubular magazine 4.

The breechblock assembly 15 continues its travel towards the back of the receiver assembly 2 and enables the ejection of the spent cartridge 3, which is extracted from the barrel chamber 7.

Afterwards, the feed system linked to the trigger guard assembly 14 and the closure of the breechblock assembly 15 through the intermediary of the action caused by the recuperator spring, enables the insertion of the new loaded cartridge 3 in the chamber 7 of the barrel assembly 5.

Figure 13:
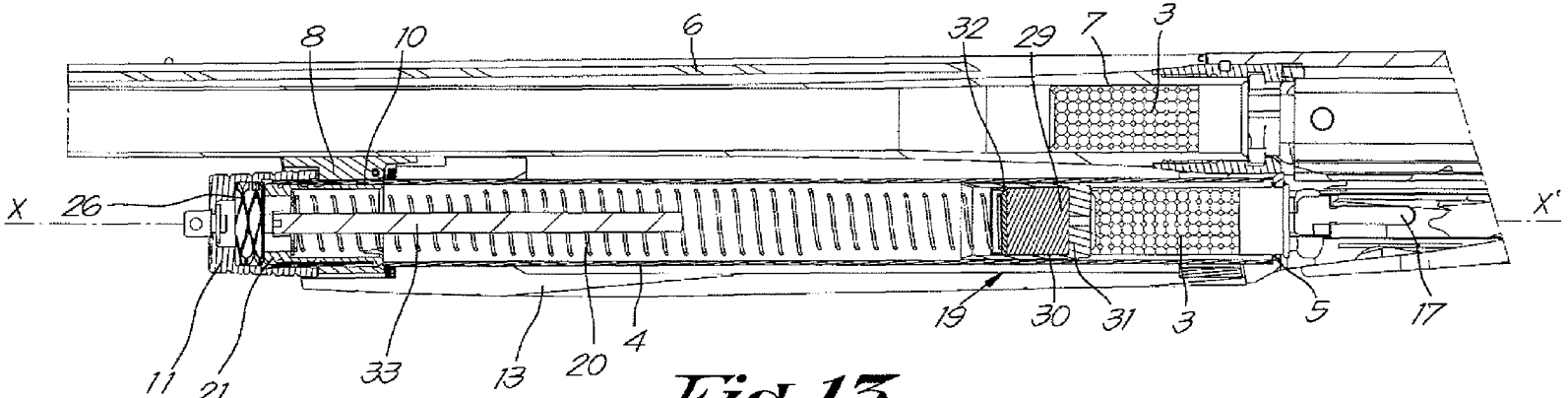

Then the breechblock assembly 15 locks into the barrel assembly 6, as illustrated in FIG. 13.

This situation corresponds to the starting situation of FIG. 3, but this time there is one less loaded cartridge in the tubular magazine 4.

Figure 14:
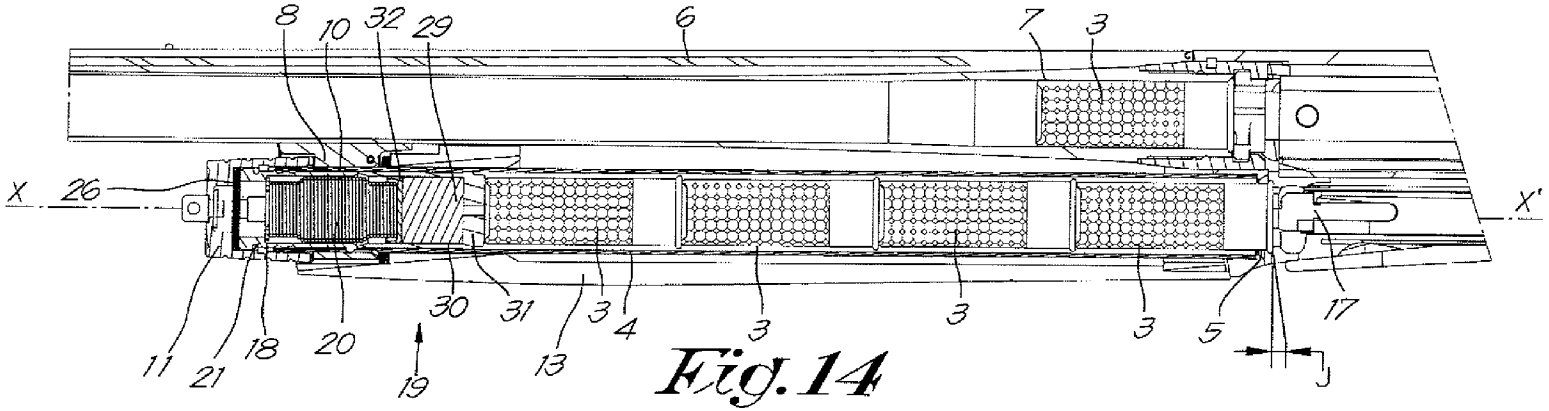
Figure 15:
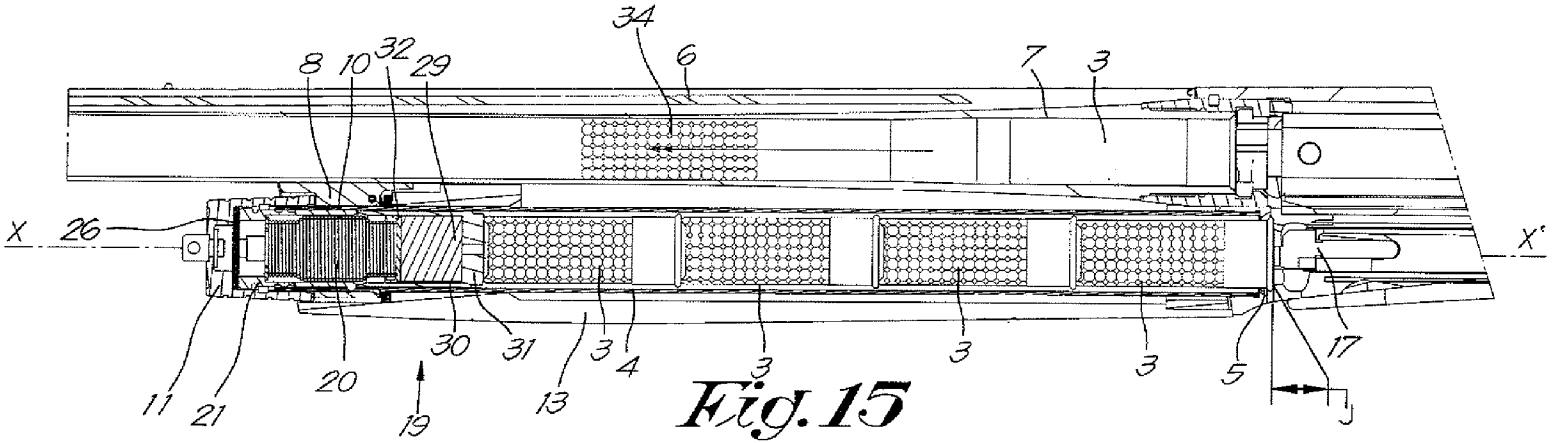
Figure 16:
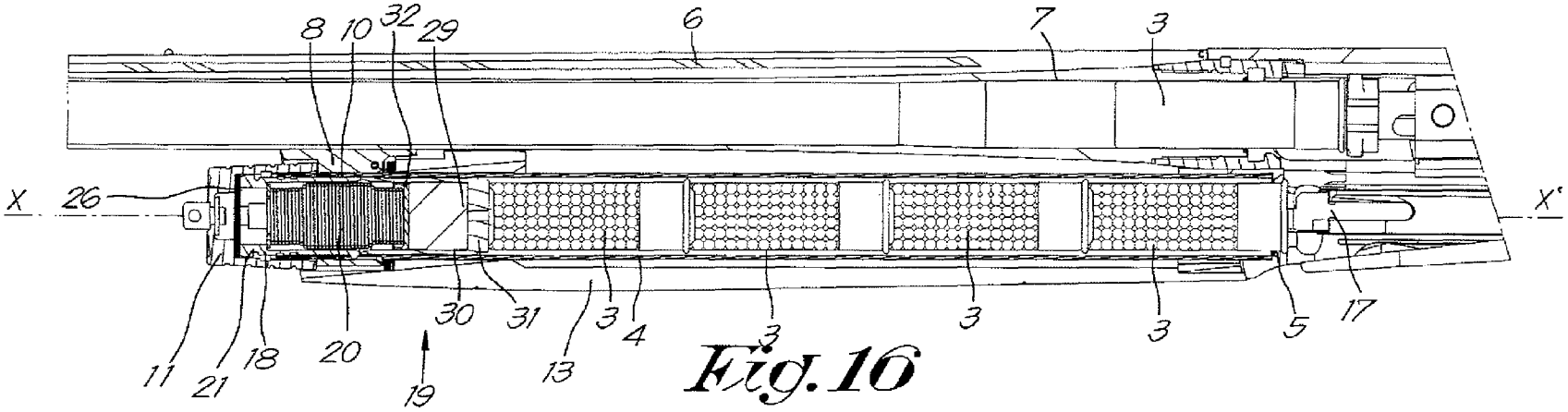
Figure 17:
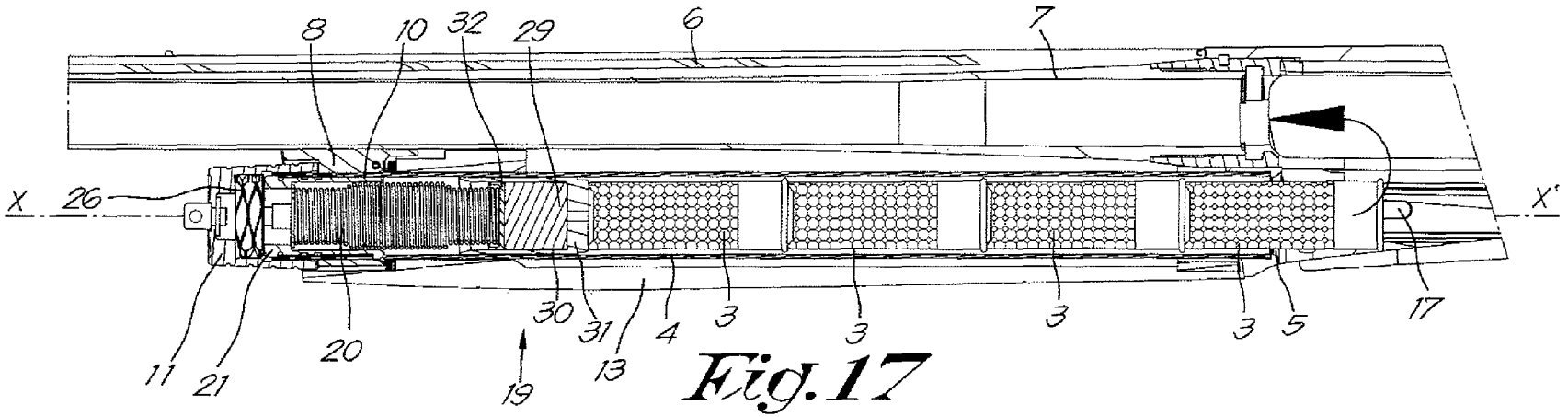
Figure 18:
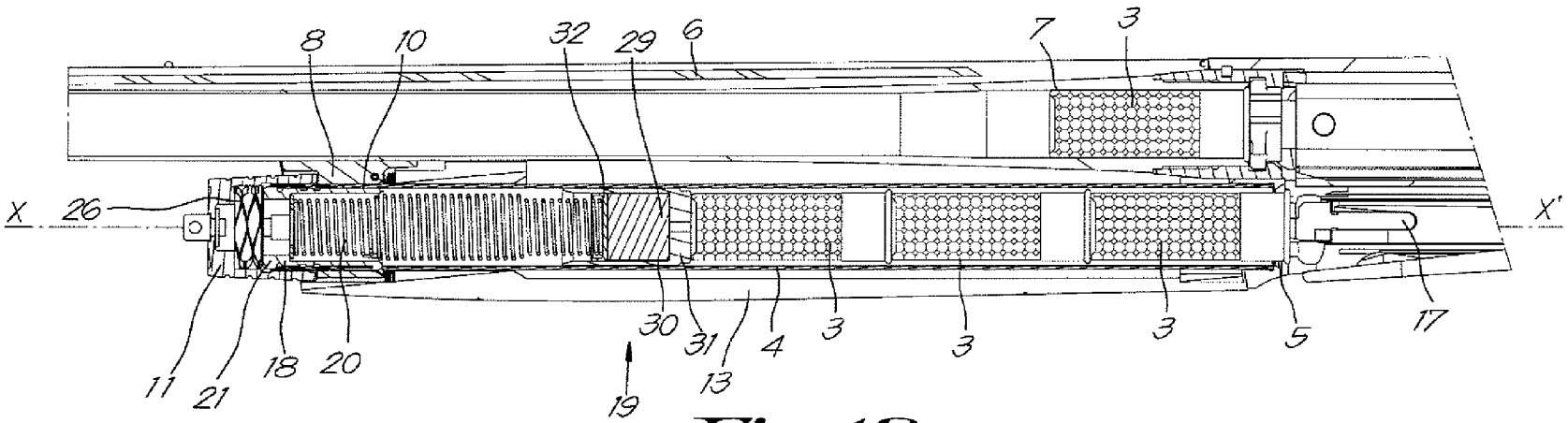

FIG. 14 shows a variant of a gun 1 according to the invention that differs from the gun 1 described above, due to the fact that the gun 1 is not provided with a restrictor 33 for the number of cartridges in the tubular magazine 4.

Because of this, it becomes possible to load the tubular magazine 4 with four loaded cartridges 3, as is the case in FIG. 14 in which a cartridge 3 is situated in the chamber 7, ready to be fired.

In the example of this FIG. 14, the cartridges are cartridges with a maximum length as defined by the SAAMI standards in the United States.

In actual fact, commercial cartridges rarely reach this maximum length.

In the situation of FIG. 14, the cartridges 3 in the tubular magazine 4 are pushed against the cartridge stop 17. The spring is partially compressed, while preserving a little of the travel for shock absorption, for example of the order of 1 to 2 mm.

When the cartridge 3 in the chamber is fired, the cartridges 3 in the tubular magazine 4 are propelled towards the front against the cartridge follower assembly 19 through the same recoil effects of the weapon and the inertia of the mass of the cartridges 3 as already explained above.

The impact of all of the cartridges 3 in the tubular magazine on the cartridge follower assembly 19 is absorbed by the shock absorber of the follower 29, and by the fact that the magazine bottom 18 leaves the tubular magazine 4 towards the front through the cumulative force of the impact of all the cartridges 3 and the force of the magazine spring 20, while compressing the shock absorber 26 of the magazine bottom 18 in the assembly screw 11.

It is clear that the shock absorber 26 of the tube bottom 18 and the shock absorber 29 of the cartridge follower assembly 19 can each be applied separately, the one without the other.

The forward direction must be taken from the point of view of a shooter with his gun in the firing position.

Summarised, the advantages can predominantly be assigned to the improvements explained hereafter with respect to a classical gun:

Introduction of a shock absorber in the assembly nut 11: in the case of the figures, the shock absorber happens to be a spring that is joined with the assembly nut 11, which nut, in addition to its assembly function of the barrel assembly 6 on the receiver assembly 2, is in contact with the magazine bottom 18 through the intermediary of the magazine bottom shock absorber 26.

Adapting the fixation of the magazine bottom 18 in the tubular magazine 4: the magazine bottom 18 can slide over a travel distance "D" while remaining joined with the tubular magazine 4, said travel distance allowing the magazine bottom 26 to reduce the impact of the cartridge follower assembly 19 with, either the magazine reducer 33 or the magazine bottom 18 or both.

Introduction of a shock absorber 29 in the interior of the cartridge follower assembly 19: in the present example, the shock absorber 29 is manufactured from a shock-absorbing viscoelastic technical material allowing deformation within the cartridge follower 19. In order to prevent the material of the shock absorber 29 from being damaged, said shock absorber 29 is protected by a spring support 32 that can slide in the interior of the cartridge follower, enabling a correct functioning of the shock absorber 29.

It should be noted that the invention concerns a classical type of gun without inertia mass that is separated from the cartridge follower assembly, which is provided for reducing the recoil shock on the shoulder of the shooter as is the case in U.S. Pat. No. 3,650,060.

It is clear that the invention is by no means limited to the examples described above, and that many modifications can be made to the gun described above without departing from the scope of the invention.

The invention claimed is:

1. An improved gun with automatic loading of cartridges, comprising a receiver assembly, a barrel assembly, a cartridge loader in the form of a tubular magazine that opens out at the receiver assembly, and which extends in the axial direction X-X' in a way essentially parallel to the axis of the barrel and which is provided with a magazine bottom at the front end of the magazine, the barrel assembly being assembled with the receiver assembly by means of an assembly nut screwed on the front end of the tubular magazine, said tubular magazine being provided with a cartridge follower assembly that slides in the axial direction X-X' in the tubular magazine and with a magazine spring mounted between the magazine bottom and the cartridge follower assembly, the tubular magazine being provided or not with a magazine reducer, wherein:

the tubular magazine is equipped with a magazine bottom shock absorber that is joined with the assembly nut, which nut, in addition to its assembly function, is in contact with the magazine bottom through the intermediary of the magazine bottom shock absorber;

the magazine bottom can slide over a travel distance D while remaining joined with the tubular magazine, said travel distance allowing the magazine bottom shock absorber to damp the impact of the cartridge follower assembly with, either the magazine reducer or the magazine bottom or both;

the cartridge follower assembly being provided with a shock absorber between the cartridge follower and the magazine spring.

2. The gun according to claim 1, wherein the shock absorber of the magazine bottom is formed by a spring that pushes against the magazine bottom and which, with respect to the magazine bottom, is located on the opposite side of the magazine spring.

3. The gun according to claim 1, wherein the assembly nut is screwed on the front end of the tubular magazine in such a way that the magazine bottom is pushed back in the tubular magazine over a distance against the force exerted by the magazine spring.

4. The gun according to claim 2, wherein the spring that forms the shock absorber of the magazine bottom is chosen to be a spring, which at rest, is more resistant to compression than the magazine spring in its compressed state.

5. The gun according to claim 1, wherein the magazine spring pushes against the shock absorber of the cartridge follower assembly.

6. The gun according to claim 5, wherein the shock absorber of the cartridge follower assembly is manufactured from a shock-absorbing viscoelastic technical material allowing deformation within the cartridge follower.

7. The gun according to claim 5, wherein the shock absorber of the cartridge follower assembly is mounted in a hollow of the cartridge follower and that this shock absorber pushes against the magazine spring through the intermediary of a support that can slide in the axial direction X-X' in the hollow of the cartridge follower for the protection of the material of said shock absorber against damages.

* * * * *